US006408667B1

(12) United States Patent
de Jesus, Jr.

(10) Patent No.: US 6,408,667 B1
(45) Date of Patent: Jun. 25, 2002

(54) FOUR-HIGH MILL STAND ROLL CHANGE DEVICE, A METHOD OF RETROFIT, AND A ROLL CHANGE DEVICE THEREFROM

(75) Inventor: Jose M. de Jesus, Jr., Abington, MD (US)

(73) Assignee: Bethlehem Steel Corporation, Bethlehem, PA (US)

( * ) Notice: Subject to any disclaimer, the term of this patent is extended or adjusted under 35 U.S.C. 154(b) by 106 days.

(21) Appl. No.: 09/696,835

(22) Filed: Oct. 26, 2000

(51) Int. Cl.[7] ..... B21B 31/07

(52) U.S. Cl. ..... 72/238; 72/239; 72/245; 29/401.1

(58) Field of Search ..... 72/237, 238, 239, 72/245; 29/401.1

(56) References Cited

U.S. PATENT DOCUMENTS

| | | | | | |
|---|---|---|---|---|---|
| 3,171,304 | A | | 3/1965 | Sims et al. | 80/1 |
| 3,312,096 | A | | 4/1967 | Stubbs et al. | 72/238 |
| 3,504,517 | A | * | 4/1970 | Clement | 72/239 |
| 3,638,468 | A | * | 2/1972 | Fukui et al. | 72/239 |
| 3,651,679 | A | * | 3/1972 | Shumaker | 72/238 |
| 3,747,387 | A | * | 7/1973 | Shumaker | 72/239 |
| 3,861,189 | A | | 1/1975 | Lindermann | 72/238 |
| 3,864,954 | A | | 2/1975 | Eibe et al. | 72/238 |
| 3,877,276 | A | | 4/1975 | Petros | 72/238 |
| 4,162,626 | A | * | 7/1979 | Decima et al. | 72/238 |
| 4,510,783 | A | | 4/1985 | Römmen et al. | 72/200 |
| 4,552,007 | A | | 11/1985 | Mantovan | 72/239 |
| 4,763,505 | A | | 8/1988 | Klute et al. | 72/238 |
| 4,976,128 | A | | 12/1990 | Tajima | 72/238 |
| 5,090,228 | A | | 2/1992 | Schmiedberg et al. | 72/238 |
| 5,782,126 | A | | 7/1998 | Drigani et al. | 72/239 |
| 6,038,905 | A | | 3/2000 | Cherubini | 72/239 |

* cited by examiner

*Primary Examiner*—Ed Tolan
(74) *Attorney, Agent, or Firm*—Harold I. Masteller, Jr.

(57) ABSTRACT

The invention is directed to a roll change device for use in a four-high rolling mill stand, and in particular it is directed to retrofitting an existing four-high rolling mill stand with a roll change device comprising actuators that are fastened to opposing inboard exterior surfaces of the lower backup roll chocks in the mill stand and a pair of spaced apart lift-rails attached to the actuators by lift-rail hooks and positioned to engage the lower work roll chocks of the mill stand when the actuators are operated. The roll change device further includes a self-contained roll staging platform that is installed as a single unit within the mill floor adjacent the four-high rolling mill stand or removed as a single unit from its position within the mill floor.

19 Claims, 10 Drawing Sheets

FOUR-HIGH MILL STAND ROLL CHANGE DEVICE, A METHOD OF RETROFIT, AND A ROLL CHANGE DEVICE THEREFROM

FIELD OF THE INVENTION

The disclosed invention is directed to a roll change device for removing and inserting work rolls in a four-high rolling mill stand, and in particular, the invention is directed to retrofitting an existing four-high rolling mill stand with a roll change device that will simplify removing worn work rolls from the mill and inserting refurbished or new work rolls into the mill. The roll change device is capable of being installed on an existing four-high mill stand without making modifications to the roll stand housing, and it is particularly suited for retrofit in an existing four-high rolling stand where the work roll chocks are captured within the backup roll chocks. The roll change device is installed in an existing mill stand with relatively minor modifications being made to the existing roll chocks and with no modifications being made to the mill stand architecture and housings.

BACKGROUND OF THE INVENTION

State of the art rolling mills include counter-opposed upper and lower work rolls supported in bearing chocks that are mounted on opposite sides of the rolling mill stand. In a four-high mill, the upper and lower work rolls are also supported by respective upper and lower backup rolls that are also supported in bearing chocks that are mounted on opposite sides of the rolling mill stand housing. In some instances, the chocks of the work rolls are at least partly captured within and laterally restrained by the backup roll chocks.

Normal practice in a rolling mill operation dictates that the work rolls must be periodically removed from service for either grinding to restore the working surface, or for other maintenance on the rolling mill stand. During such shutdowns, the work rolls are removed from the mill stand along the axial direction of the rolls. In a where the work roll chocks are captured within the backup roll chocks, the current state of the art includes a variety of methods for removing and/or installing the work rolls in the mill. Such methods include roll removal devices suspended from cranes in combination with heavy counterweights that balance the weight of the work roll(s). These crane-handled roll change devices are labor intensive, requiring a significant downtime to perform work roll changes.

Retrofitting a four-high rolling mill stand with a roll change device is expensive, time consuming, and generally requires significant modifications to the mill stand housing and related components. For example, U.S. Pat. No. 6,038,905 to Cherubini describes a device to remove working rolls in a four-high roll stand where the work roll chocks are contained within the backup roll chocks. The roll change device comprises a lifting system including actuators that are mounted below the lower backup roll chocks and anchored to stationary parts of the mill stand at a location within the space defined between the lower backup roll chocks. The lifting system further includes extension rods attached to and extending between the actuators and sliding rails that is raised or lowered in response to operating the lifting system actuators. A pair of sliders extends longitudinally from one side of the mill stand to the opposite side of the mill stand. When the actuators are operated to move the extension rods in a vertical direction, the sliding rails are either a raised so that they engage the sliders attached to the lower work roll chocks, or they are lowered to a rolling or working position. The vertical moving sliding rails engage the work roll chock sliders and lift the work rolls for removal from the rolling stand.

Although it appears that the Cherubini roll change device may be an improvement over the prior art, the inventor has failed to recognize a number of inherent problems associated with his device. For example, the Cherubini device requires the lift system and actuators to be either fastened to the mill housing or to a slider used to remove the lower backup roll from the mill stand. In the first instance, if the lifting system is attached to the mill housing, changes and modifications must be made to the mill stand architecture at a location below the lower backup rolls.

In instances where the lifting system is fastened to a slider, it would be necessary to provide a complex slider system for lower backup roll removal. Such a slider attached lifting system would be expensive to implement and would require major changes to the mill architecture.

Furthermore, the sliding rails disclosed in the 905 patent are limited in length to the distance between the inboard sides of the lower backup roll chocks. In other words, the sliding rails cannot extend outboard of the chocks. This makes it necessary to provide a slider that is solidly fastened to the lower work roll chocks in order to enable removal or insertion of a work roll in the mill stand. Such a slider arrangement complicates the disassembly and reassembly of lower work roll chocks and thereby exacerbates maintenance and work roll grinding operations. Additionally, the "solidly" fastened slider attached to the lower work roll chocks may restrain the chocks and prevent proper and independent axial and lateral alignment with the necks of the lower work roll as well as with the corresponding surfaces of the backup roll chocks. Such improper alignment can have disadvantageous effects on the work roll bearings and the quality of the product being rolled.

SUMMARY OF THE INVENTION

A roll change device, according to the invention, comprises a pair of spaced apart lower work roll lift assemblies, each lift assembly including an actuator and lift-rail arrangement positioned within a four-high rolling mill stand to remove and insert work rolls, in combination with a removable, self-contained roll staging platform assembly positioned adjacent the mill stand to receive worn work rolls and to deliver new or refurbished work rolls. The actuator and lift-rail arrangement is fastened to opposing inboard facing surfaces of the spaced apart lower backup roll chocks, the actuator and lifting rail arrangement improving roll chock alignment and bearing life when compared to past roll change devices, as well as simplifying operations related to the removal and insertion of work rolls when retrofit into an existing four-high rolling stand. The removable self-contained roll staging platform provides means for delivering and removing work rolls, and the platform is removable as a single unit from its working position within the mill floor to provide millwright access to the lower backup roll pit. The present roll change device invention is particularly suited for retrofit into an existing four-high rolling mill stand with relatively minor modifications to the existing mill parts and little or no modifications to the mill stand housings, the retrofitted mill stand and roll change device reducing maintenance related downtime and extending bearing life when compared to earlier roll change devices that are solidly fastened to the work roll chocks.

BRIEF DESCRIPTION OF THE DRAWINGS

The above and other objects and advantages and novel features of the present invention will become apparent from the following detailed description of the preferred embodiment of the invention illustrated in the accompanying drawings, wherein.

DETAILED DESCRIPTION OF THE PREFERRED EMBODIMENT

Figure 1:
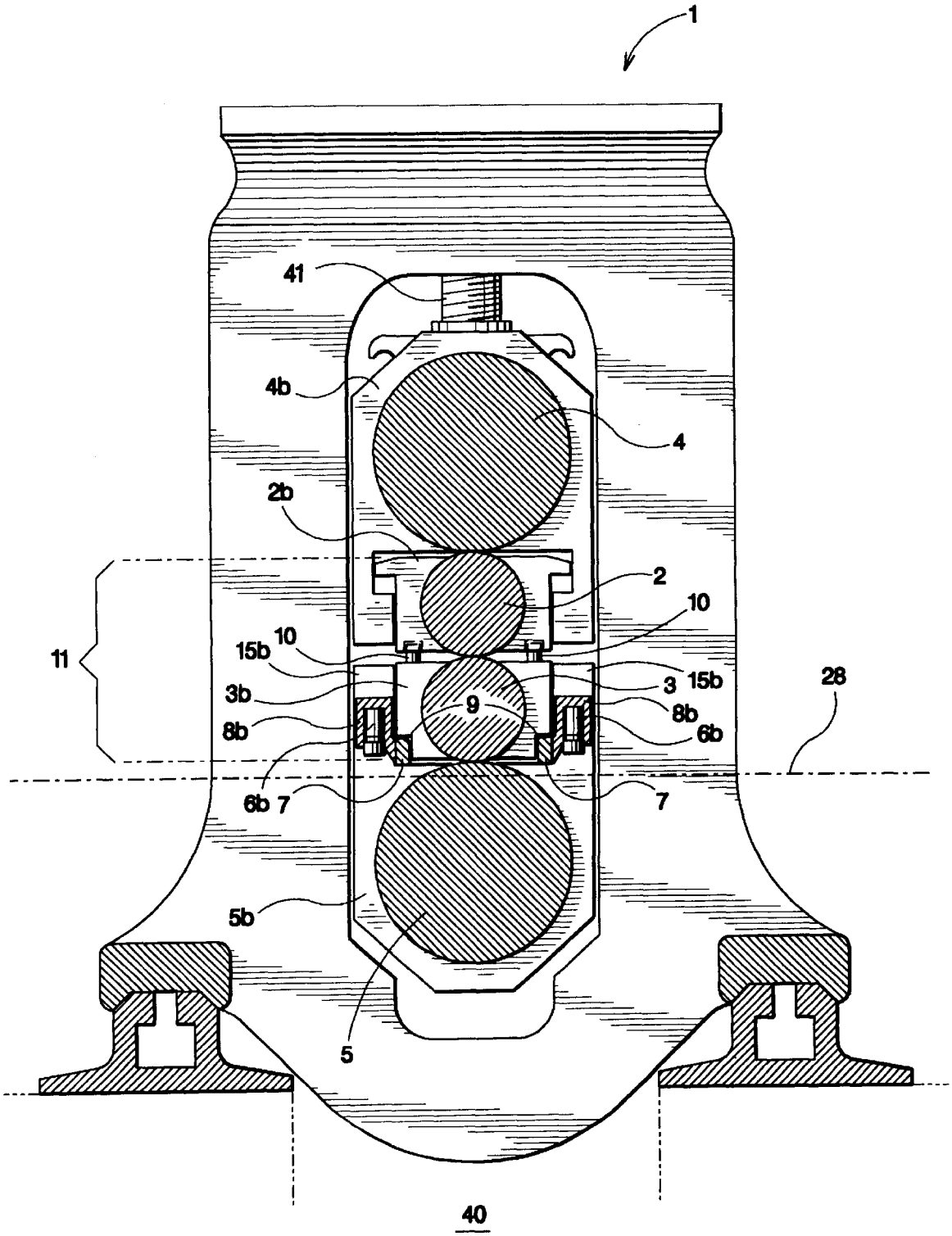
FIG. 1 is a longitudinal cross-section view taken through a four-high mill stand showing the roll change device of the present invention.
Figure 2:
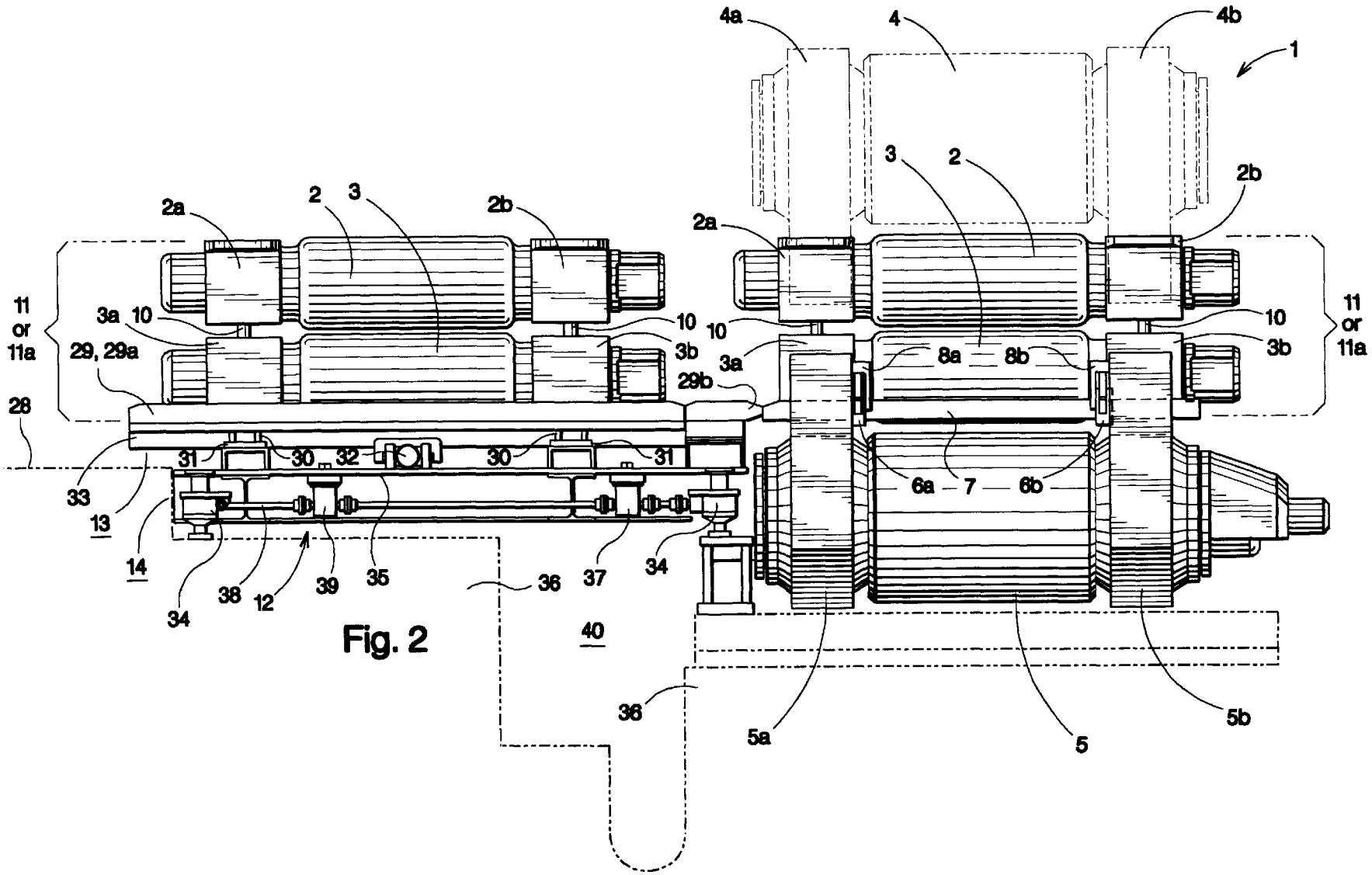
FIG. 2 is a transverse cross-section view taken through a four-high mill stand showing the roll change device of the present invention.

Referring to FIGS. 1 and 2, the preferred embodiment of the present roll change device invention is shown installed on a four-high rolling mill stand 1 where the work roll chocks are captured within the backup roll chocks. The present invention may be incorporated into the manufacture of a new four-high mill stand, or it may be installed as a retrofit in an existing mill stand. Four-high rolling mills of the past typically include a mill stand 1 comprising an upper work roll 2 and a lower work roll 3 supported at their ends in chocks 2*a*–2*b* and 3*a*–3*b* respectively. Flexure of the work rolls 2 and 3 from rolling forces is countered and opposed by an upper backup roll 4 and a lower backup roll that are supported at their ends by upper and lower chocks 4*a*–4*b* and 5*a*–5*b* respectively. The work roll chocks 2*a*–2*b* and 3*a*–3*b* are at least partly captured within the backup roll chocks 4*a*–4*b* and 5*a*–5*b* to laterally contain the work rolls 2 and 3 within mill stand 1 and to prevent chock movement during the rolling operations.

Figure 9:
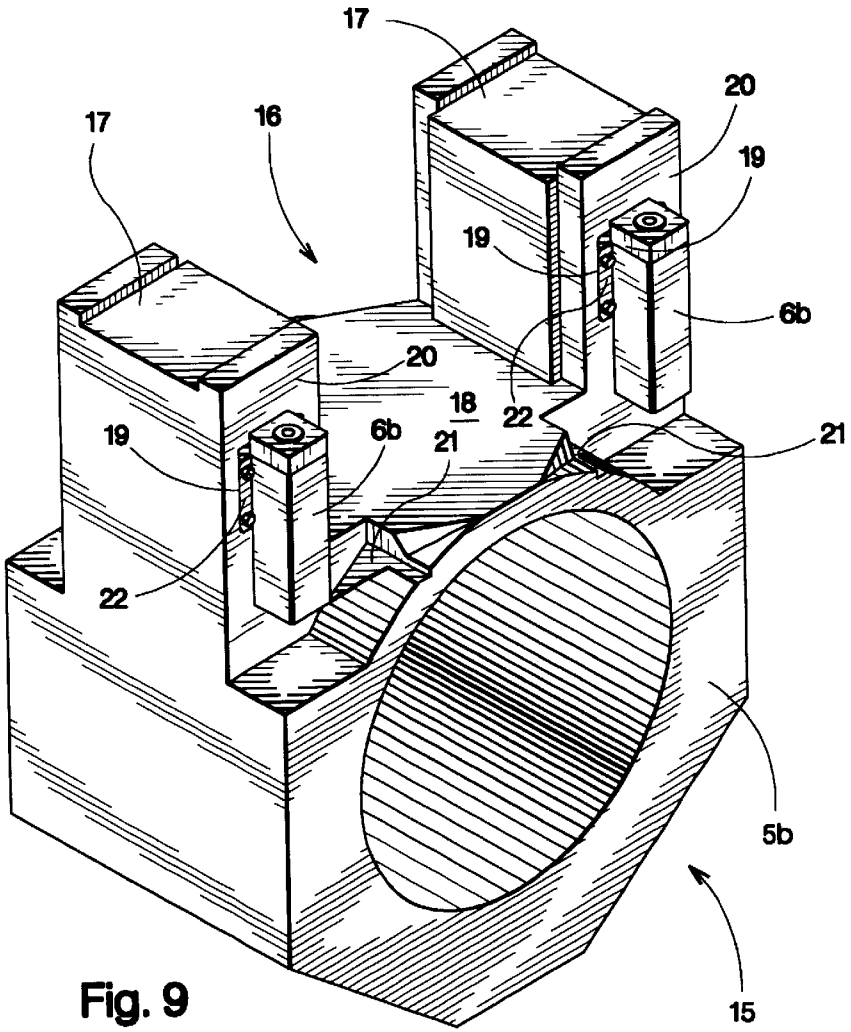
FIG. 9 is an isometric view of the chock shown in FIG. 3 with actuators installed.
Figure 13:
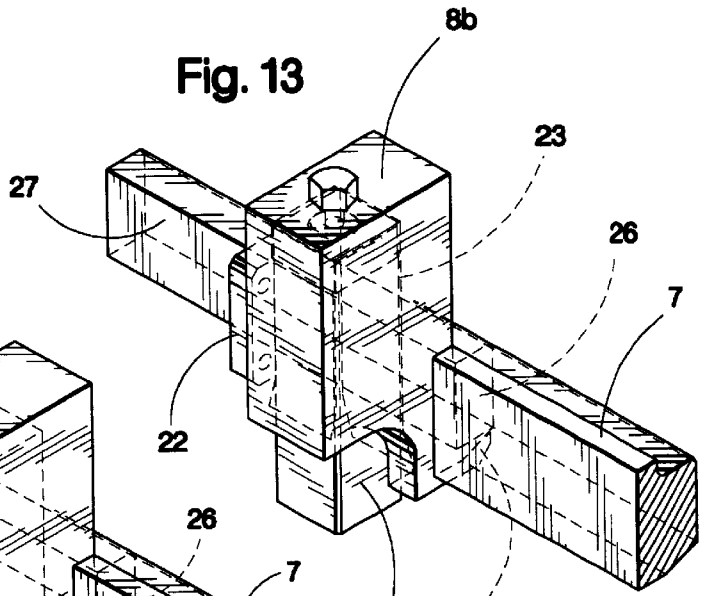
FIG. 13 is an isometric view of the assembled actuator/lift-rail arrangement.
Figure 12:
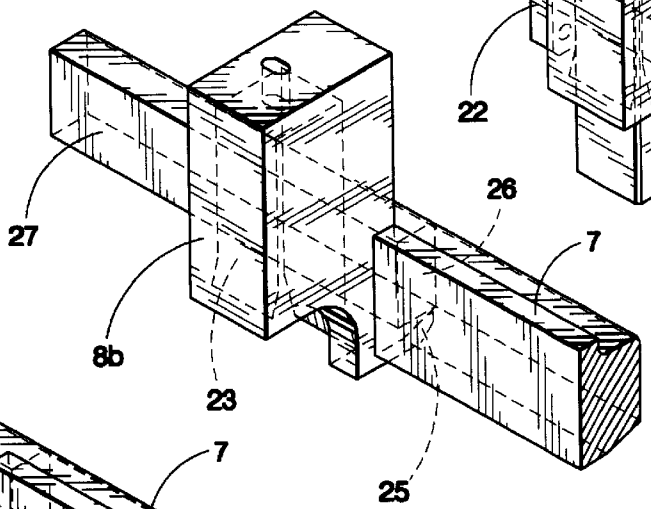
FIG. 12 is an isometric view of the lift-rail for the present invention.
Figure 14:
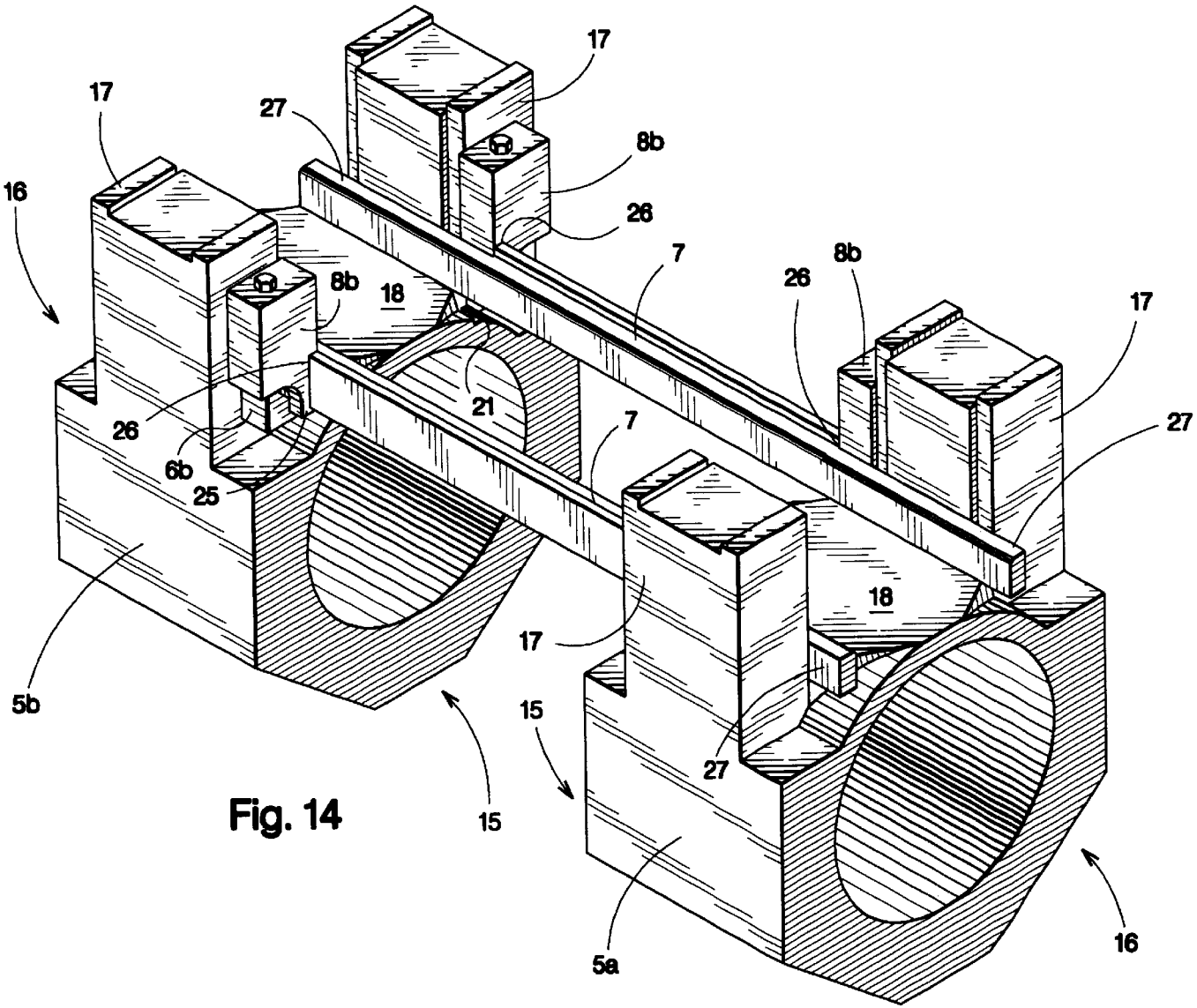
FIG. 14 is an isometric view showing the actuator/lift-rail assembly of the present invention installed on a pair of backup roll chocks.

As more clearly shown in the combination of FIGS. 1, 2, and 9, a first set of actuators 6*a* and 6*b*, located adjacent one side of work roll 3, is fastened to the opposing inboard or roll side surfaces of the lower backup roll chocks 5*a*–5*b*, and a second set of actuators 6*a* and 6*b*, located along the opposite side of work roll 3, is also fastened to the opposing inboard facing surfaces of the lower backup roll chocks 5*a*–5*b*. A lift-rail 7, shown in FIGS. 1, 2, and 14, is suspended from each set of actuators 6*a* and 6*b* by lift hooks 8*a* and 8*b* respectively so that the lift-rails extend between the lower backup roll chocks 5*a*–5*b* in a direction parallel to the longitudinal axis of the lower work roll 3. The suspended lift-rails 7 are positioned so that they will engage corresponding surfaces 9 (FIG. 1) in the lower work roll chocks 3*a* and 3*b* when the actuators 6*a* and 6*b* are operated to raise the work rolls during a roll change.

Referring again to FIGS. 1 and 2, the upper work roll chocks 2*a* and 2*b* are supported on, and removably fastened to, the lower work roll chocks 3*a* and 3*b* by fasteners 10 so that when the lift-rails 7 engage the surfaces 9 in the lower work roll chocks 3*a* and 3*b*, the upper and lower work rolls and respective chocks, are removed or installed in the mill stand, as a single work roll unit shown as 11 and 11*a*. The work roll units 11 and 11*a* may be removed from or inserted within the rolling stand using any suitable mechanism well known in the art, for example hydraulic actuators, a rack-and-pinion arrangement, or other device. In the preferred embodiment shown in FIGS. 3, 4*a*, 4*b*, and 15, the work roll units 11 are removed or inserted using a height adjustable, self-contained platform assembly 12 located within the mill floor 28 adjacent the mill stand 1. The self-contained platform 12 includes a support platform assembly 14 and a roll carriage assembly 13 for staging work roll units during a roll change.

Figure 15:
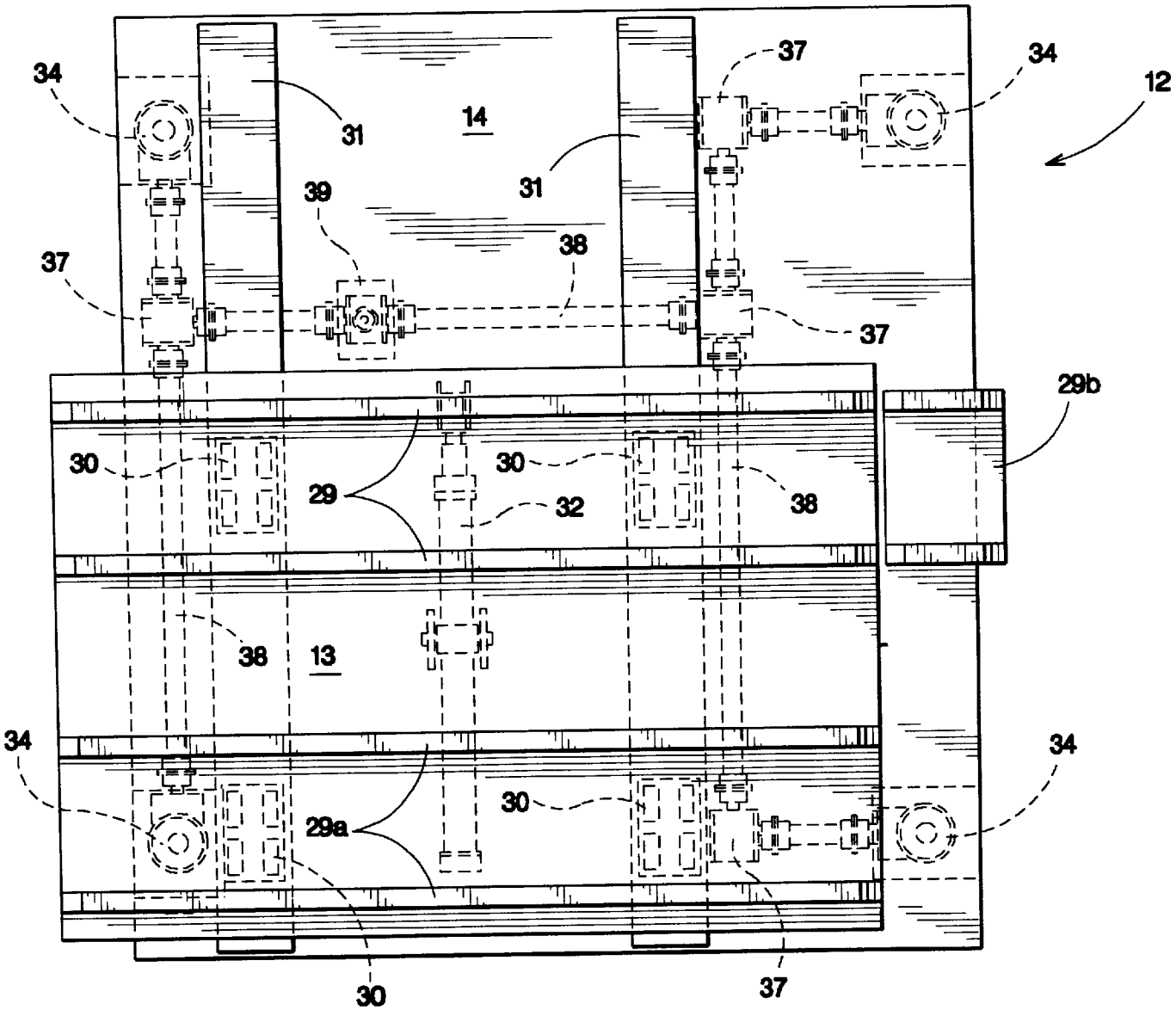
FIG. 15 is a plan view of the self-contained roll staging platform assembly of the present invention.

Referring to FIGS. 2 and 15, the roll carriage assembly 13 includes a moveable stage 33 for receiving worn work roll units 11 removed from the mill stand and for delivering new or refurbished work roll units 11*a* for insertion into the mill stand. The movable stage includes at least one and preferably two or more sets of parallel slide-rails 29 and 29*a* that are attached to the moveable stage 33 at spaced apart positions that will communicate with the lift-rails 7 when the stage is moved to align either one of the slide-rail sets 29 or 29*a* with the raised lift-rails 7. The moveable stage 33 is supported on a plurality of rollers or wheels 30 that ride along ways 31 fastened to the support platform 14. An actuator 32, is fastened to the moveable stage 33 and the support platform assembly 14 to provide a force capable of selectively moving stage 33 back and forth along ways 31 so that the slide-rails 29 or 29*a* may be aligned with the raised lifting rails 7.

The support platform 14 includes a slide-rail bridge 29*b* that is positioned within a space located between the slide-rail sets 29 or 29*a* and the lifting rails 7 as more clearly shown in FIGS. 2 and 15. The slide-rail bridge 29*b* is used in instances where the mill stand architecture would interfere with the moving carriage mounted slide-rail sets 29 and 29*a* if the slide-rail sets were lengthened to extend outward from the roll carriage 13 for engagement with the lift-rails 7. In those instances where the mill stand architecture does not interfere with so lengthened slide-rail sets, the slide-rail bridge may be eliminated without departing from the scope of this invention.

The support platform also includes a lift mechanism comprising a plurality of jack screws 34 and drive mechanisms that are operated to vertically align the slide-rails 29 and 29*a*, and the slide-rail bridge 29*b* with the raised roll change elevation of the lift-rails 7. Such elevation adjustment is necessary because during normal operation of a rolling stand, the top of the lower working roll is generally held to a constant work roll elevation relative to the roll stand. Successive grinding of both the work rolls and backup rolls change the roll diameters, and shims must be inserted between the chocks 5*a* and 5*b* and the mill stand housing 1 in order to maintain the proper lower work roll elevation described above. In other words, because the lift-rails 7 are mounted to chocks 5*a* and 5*b,* the absolute elevation of the lift-rails 7, relative to the rolling stand and mill floor, will vary according to the shims that are used to maintain a proper lower work roll elevation. When the chocks 5*a* and 5*b* of the lower backup roll 5 are shimmed to raise the roll axis to a higher elevation to compensate for a reduced backup roll diameter, the eight of the slide-rails 29 and 29*a* fastened to the moveable stage 33 must be adjusted to match the raised elevation of the lift-rails 7.

In the preferred embodiment, such elevation adjustment of the slide-rails 29–29*a* and slide-rail bridge 29*b* is accomplished using a plurality of screw jacks 34 that are fastened to the underside of the support platform jack plate 35. At least one jackscrew 34 is provided at each of the four corners of the jack plate 35. The screw jacks bare against the roll stand foundation 36, or other suitable support 36*a,* to provide a upward force for raising or lowering the jack plate 35 and the carriage assembly 13. The raising or lowering of the jackscrews enables operators to match the elevation of the slide-rails 29 and 29*a* with the raised, roll change elevation of the lift-rails 7.

The screw jacks 34 are operated with a synchronized power train that includes a miter gear 37 and drive shaft 38 arrangement driven by a combined power source and gear reducer 39 as shown in FIG. 15. The synchronized power train simultaneously raises or lowers all the screw jacks 34 so that the jack plate 35 is maintained in a horizontal plane as it is raised or lowered to match the slide-rail elevation with the lift-rail elevation. The drive input 39 may comprise any suitable power source, for example, an electric motor, a pneumatic or hydraulic wrench or nut runner, or other suitable means. The synchronized operation of the screw jacks 34 provides accuracy with respect to the adjusted height of the moveable stage 33 and attached slide-rails 29 and 29*a,* and it decreases downtime required to perform such adjustments. Once the carriage elevation is adjusted for a particular roll setup, the carriage is held at the adjusted elevation throughout the entire roll setup campaign.

Figure 3:
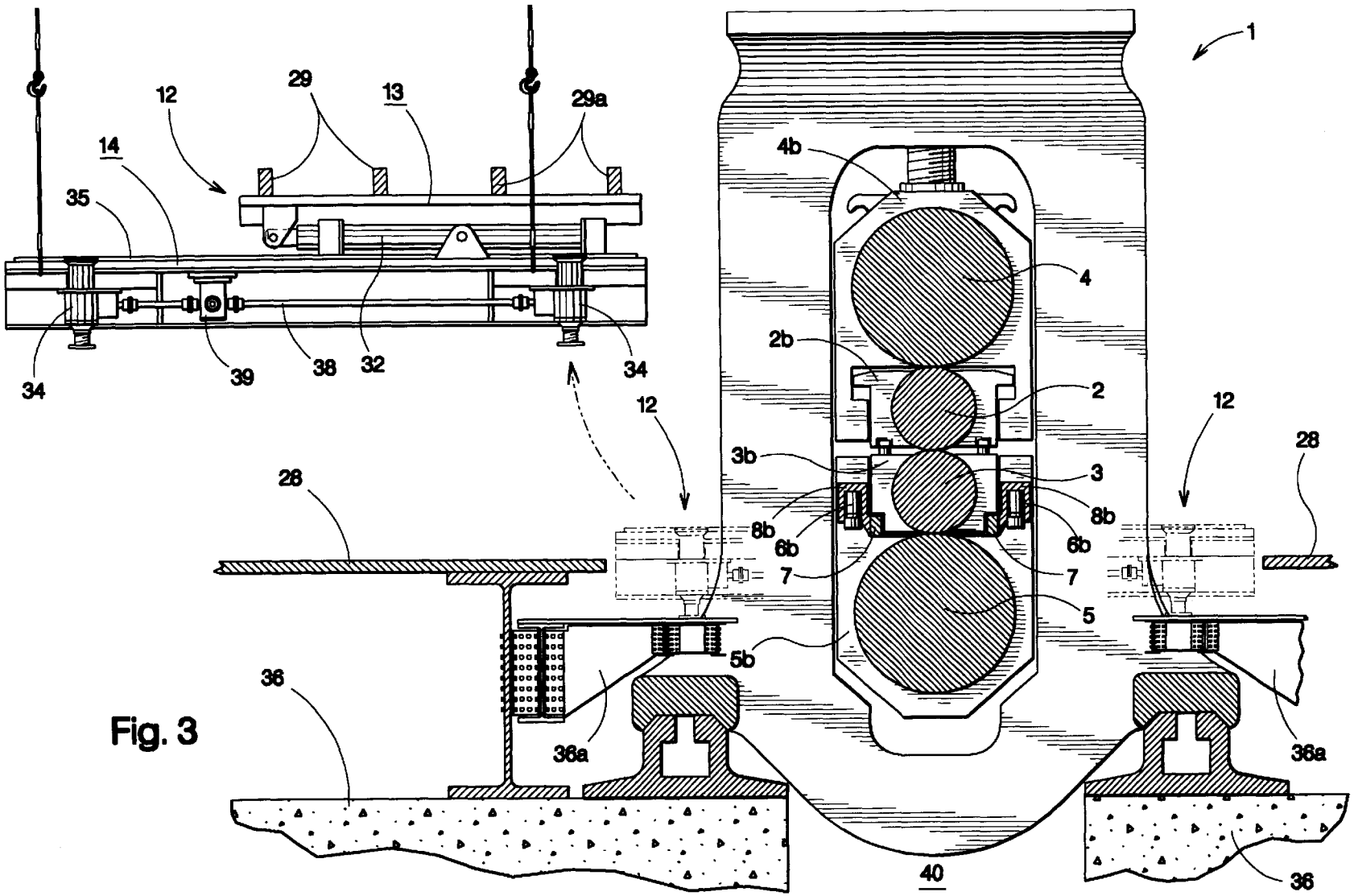
FIG. 3 is a longitudinal cross-section view taken through a four-high mill stand showing the self-contained roll staging platform assembly removed from its position within the mill floor.

Referring to FIG. 3, the carriage assembly 13, support platform 14, and related adjusting and shifting mechanisms, are assembled as a self-contained unit 12 that is positioned within the mill floor 28 adjacent the mill stand 1. Such a self-contained unit is particularly advantageous when the carriage 13, support platform 14, and their shifting and adjusting mechanisms need to be removed to gain access to the roll stand pit 40 for maintenance, or for removal and-insertion of the lower backup roll 5 that is located below the elevation of the mill floor 28.

Figure 7:
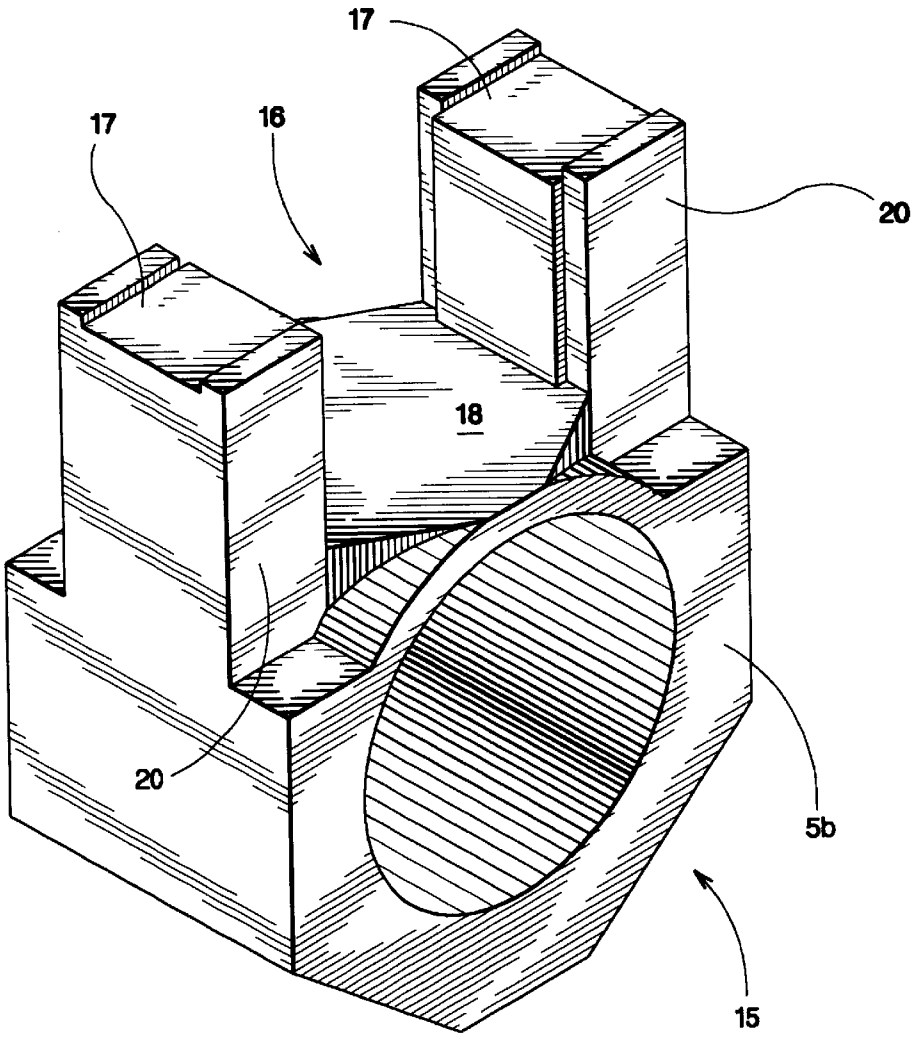
FIG. 7 is an isometric view showing a representation of a lower backup roll chock for use in a four-high rolling mill stand.
Figure 10:
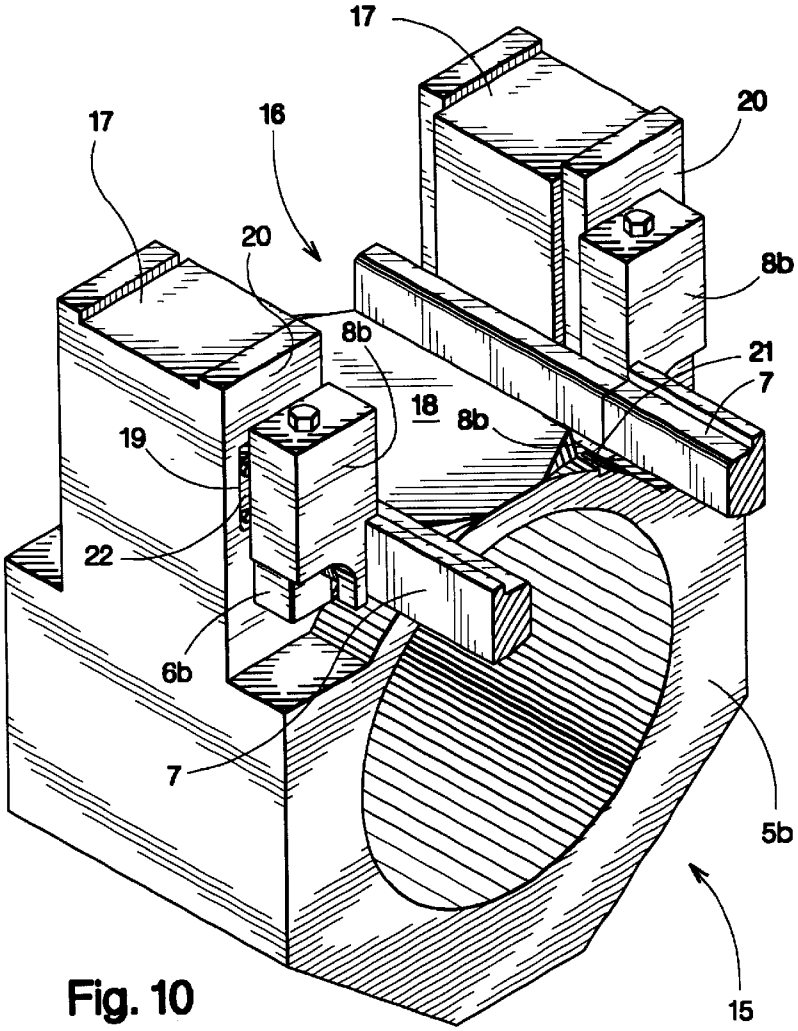
FIG. 10 is an isometric view of the chock shown in FIG. 4 with the lift-rails installed.

FIG. 7 is a representation of the lower backup roll chock used in a four-high rolling mill stand where the work roll chocks are captured within the backup roll chocks, for example chock 5*b* shown in FIG. 1. Such chocks are cast to include an inboard side 15, an outboard side 16, and an arrangement of upstanding legs 17. The upstanding legs 17 are spaced apart to form a pocket 18 shaped to receive and capture within the pocket the lower work roll chocks 3*a* and 3*b*. In order to retrofit such existing four high mill stands with the roll change device of the present invention, inboard surfaces along each of the lower backup roll chocks 5*a* and 5*b* are machined to receive actuators 6*a*–6*b* as well as to provide clearance for the lift-rails 7 and rail hooks 8*a*–8*b* shown in FIGS. 1 and 2.

Figure 8:
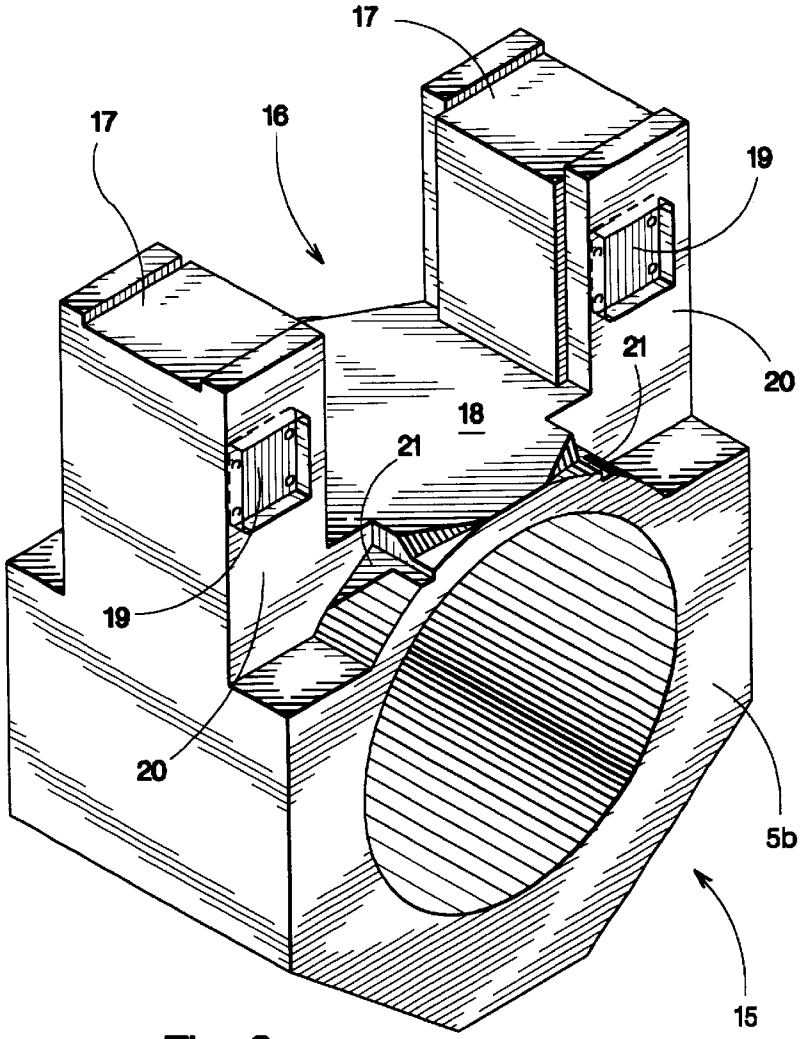
FIG. 8 is an isometric view showing the chock in FIG. 2 machined to receive the roll change actuator and lift-rail assembly of the present invention.
Figure 11:
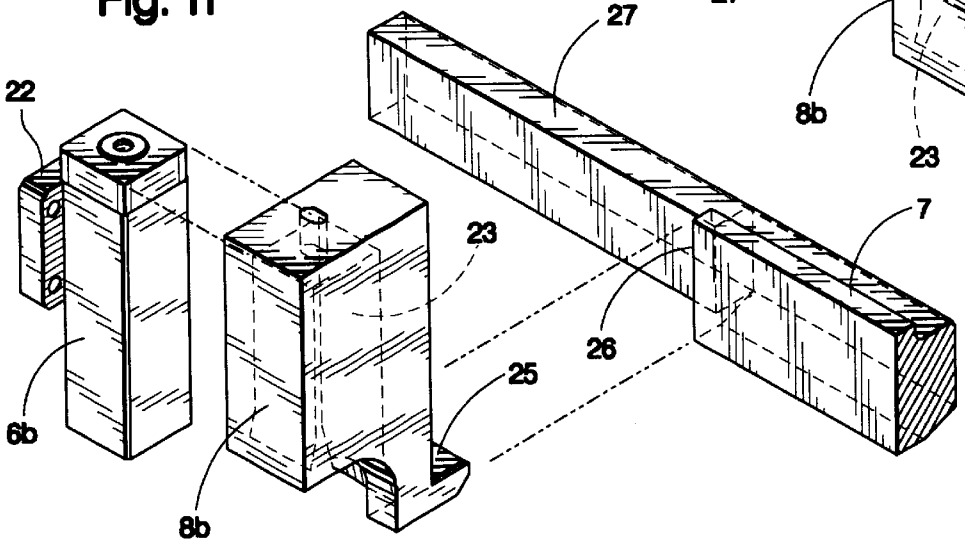
FIG. 11 is an exploded view of the actuator/lift-rail assembly of the present invention.

Referring to FIG. 8, the inboard surface 20 of each upstanding leg 17 is machined to provide an attachment surface 19 that is shaped to receive an actuator mounting plate 22 (FIG. 11). In the preferred embodiment of the present invention, the attachment surface is a pocket 19 that is machined along the inboard facing surface 20 of the upstanding leg 17. However, it should be understood that the inboard facing surface 20 of the upstanding leg may be simply machined to provide a flat coplanar surface for attaching mounting plate 22 without departing from the scope of this invention. Additionally, the top portions of the chock castings 5*a* and 5*b* are machined to provide a clearance 21 for the lift-rails 7 and rail hooks 8*a*–8*b* to prevent the lift-rails and hooks from impacting upon the upper surfaces of the chocks 5*a* and 5*b* when the roll change device is operated.

After the machining is completed, actuators 6*a*–6*b* are fastened to the machined attachment surfaces 19 provided in the upstanding legs 7*b* of chocks 5*a* and 5*b* by fastening the actuator mounting plates 22 within the machined surfaces 19 with machine screws, bolts, welding, or the like as shown in FIGS. 9 and 14. The actuators are positioned to provide a first set of actuators 6*a*–6*b* adjacent one side of the lower work roll 3 and a second set of actuators 6*a*–6*b* adjacent the opposite side of the lower work roll 3. In the preferred embodiment, the actuators are face-mounted by seating and fastening the actuator bracket plates 22 into recessed pockets 19 that are machined into the inboard faces 20 of the upstanding legs 7*b* in chocks 5*a* and 5*b* of the lower backup roll. The machined pocket 19 provides contact lands between the actuators 6*a*–6*b* and the chocks 5*a* and 5*b* to counter vertical, horizontal, and the torque forces generated by the actuators during a roll change.

Referring to the series of drawing FIGS. 10–14, after both sets of actuators 6*a*–6*b* are fastened to the upstanding legs 17, the lift-rail portion 7 of the roll change device is attached to the lower backup roll chocks by placing the lift-rail hooks 8*a* and 8*b* onto their corresponding actuators 6*a* or 6*b*. The lift-rail hooks 8*a* and 8*b* comprise an inverted cup like shape having a recessed cavity 23 shaped to fit over their corresponding actuators 6*a* or 6*b* so that the inside surface 42 of the inverted base within the cup like shape engages the extendable portion of the actuators 6*a* or 6*b*. The lift-rails 7 are suspended from the rail hooks 8*a* and 8*b* in a direction parallel to the longitudinal axis of the working and backup rolls. As more clearly shown in FIGS. 11–13, each lift-rail 7 includes at least two lift hooks 8*a* and 8*b* that are spaced apart along the length thereof so that the lift-rail hooks are positioned to engage the actuators 6*a* and 6*b* attached to the inboard surfaces 20 of the upstanding chock legs 17. Each lift hook 8*a* and 8*b* comprises an inverted cup like shape having a hook portion that includes the recessed cavity 23 shaped to fit over and engage the actuators 6*a* or 6*b* so that when the extendable portions of the actuators are operated to apply an upward force against the inside surface 42 of the inverted base, the lift-rails 7 are either raised or lowered to engage lift-rail extensions 27 against corresponding lift surface 9 in the lower work roll chocks 3*a* and 3*b* (FIG. 1). Each lift hook 8*a* and 8*b* further includes a bracket portion 24 extending in a downward direction from the hook portion to provide a seat 25 for attaching, by welding or other suitable means, a notched portion 26 at opposite end portions of lift-rails 7. The attached lift-rails extend parallel to the roll axis and outboard of the lift hooks and actuators to invade the space located below the lift surfaces 9 in the lower work roll chocks 3*a* and 3*b* as shown in FIGS. 1 and 2. The lift-rails are capable of vertical movement in response to operation of the actuators 6*a* and 6*b,* and the rails are moveable to both a lowered stored position for mill rolling operations (FIG. 5), and a raised roll change position for removal or insertion of work rolls. The lift surfaces 9 are located along a bottom portion of the chocks 3*a* and 3*b* and are shaped to correspond with the size and shape of the lift-rail end extensions 27 that extend outboard of the lift-rail hooks. The lift surfaces 9 are shaped to provide a non-contacting clearance between when the lift-rails are lowered to their stored position as shown in FIG. 5, and to engage the chocks 3*a* and 3*b* during operation of the rolling stand, and the surfaces 9 are shaped to receive and engage the lifting rails 7 when they are raised for roll change operations as shown in FIG. 6.

Figure 5:
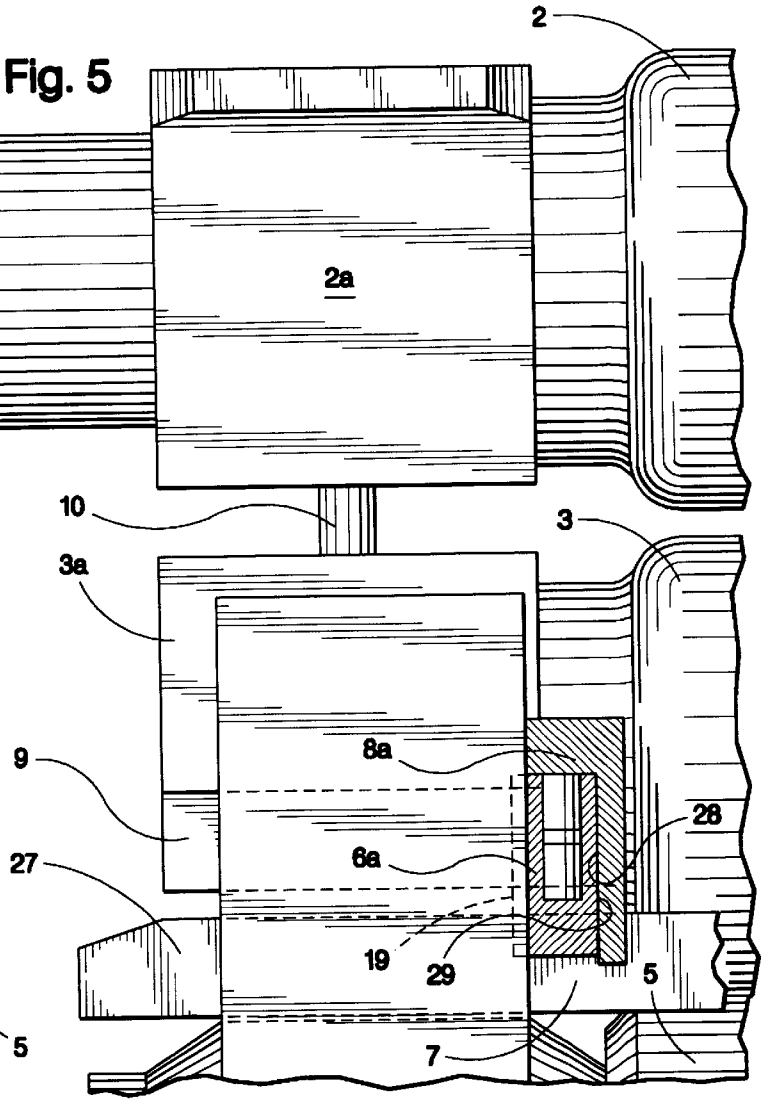
FIG. 5 is a fragmentary elevation view showing the actuator and lift-rail arrangement raised to a work roll removal/insertion position.
Figure 6:
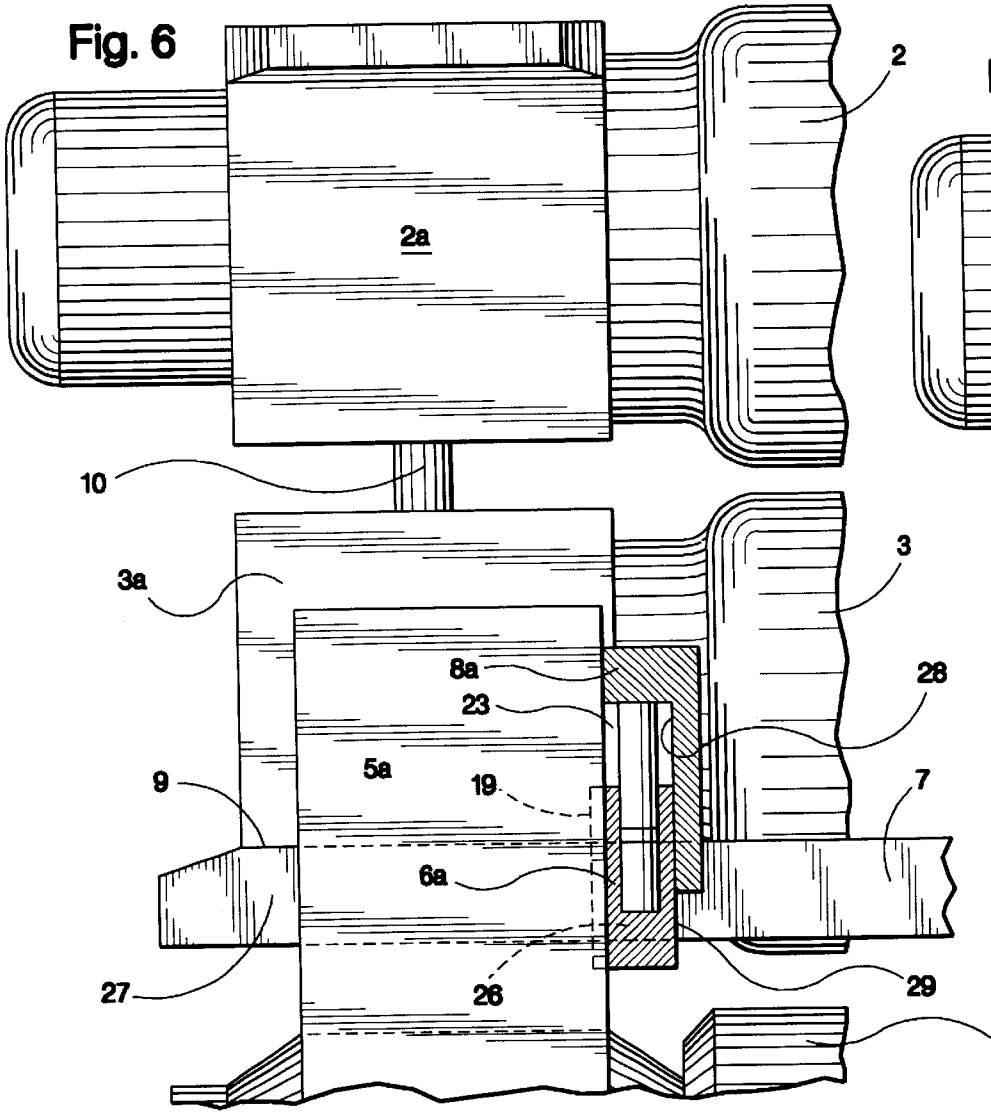
FIG. 6 is a fragmentary elevation view showing the actuator and lift-rail arrangement lowered to a working or rolling position.

More specifically, during normal rolling operations of the four-high rolling stand, the lift-rails 7 are lowered to the inactive stored position shown in FIG. 5 where the lift-rails do not contact the lower work roll chocks. As heretofore mention, such a non contacting roll change device improves roll alignment, bearing wear, and product quality over prior roll change devices that are solidly fastened to the work roll chocks. The improved roll change device of the present invention does not restrain the work roll chocks and thereby facilitates proper and independent axial and lateral alignment with the necks of the work roll as well as with the corresponding surfaces of the backup roll chocks. Such proper alignment improves both roll bearing life and product quality.

During a roll change involving the removal of a work roll unit 11 from the rolling stand 1, the upper backup roll 4 is raised out of contact with the upper work roll 2 as shown in FIG. 2. The actuators 6*a* and 6*b* are operated to raise the lift-rails 7 in an upward direction, and the upward movement causes the lift-rail extensions 27 to engage the corresponding lift surfaces 9 along the bottom portion of the lower work roll chocks 3*a* and 3*b*. The continuing upward movement of the lift-rails raises the chocks and lower work roll 3 vertically and out of contact with the lower backup roll 5 as shown in FIG. 6. During their vertical movement, the lift-rails are guided in an up or down direction by the cavity surfaces 28 that slidably engage corresponding outside surfaces 29 of each actuator housing 6*a* and 6*b*.

Figure 4B:
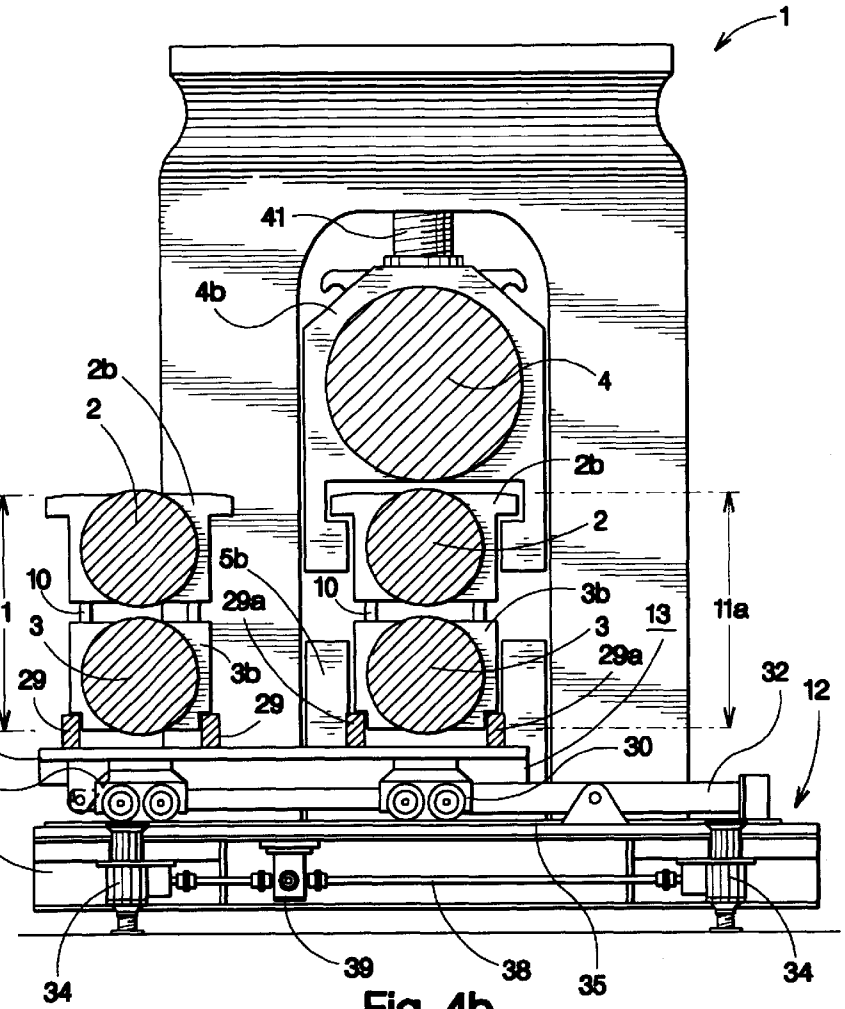
FIG. 4*b* is a cross-section through a mill stand showing a replacement work roll unit being inserted.
Figure 4A:
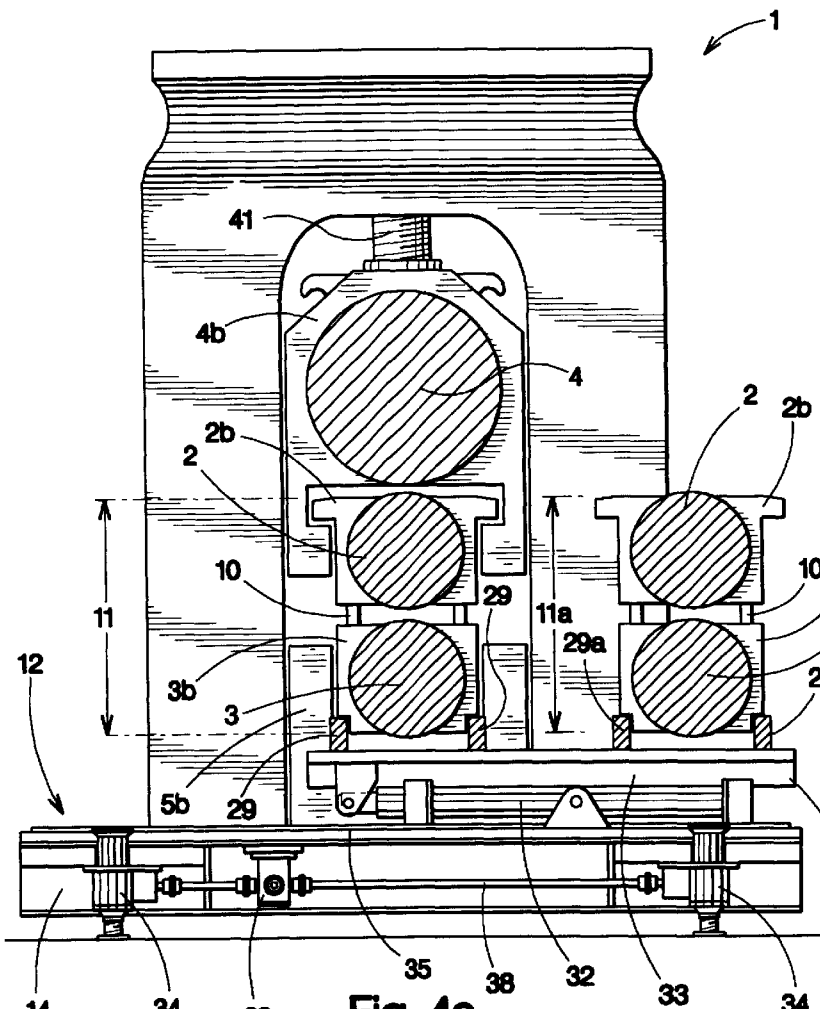
FIG. 4*a* is a cross-section through a mill stand showing a worn work roll unit being removed.

When the actuators 6*a* and 6*b* are operated to their fully extended positions, the lift-rail elevation corresponds with the elevation of the slide-rails 29 and 29*a* located on the moveable stage 33 of the carriage assembly 13 (FIGS. 2, 4*a,* and 4*b*). The work rolls 2 and 3 are raised to a position where they may be removed from the mill stand by sliding them along the lifting rails 7, across the slide-rail bridge 29*b,* and onto the slide-rail set 29. For this operation, the working rolls 2 and 3 are temporarily made coupled together with fasteners 10 to make up a single work roll unit 11 for removal as a single body from mill stand 1. Such fastening means are well known in the state of the art and can include protruding pins 10 extending upward from chocks 3*a* and 3*b* to interlock with the chocks 2*a* and 2*b* of the upper working roll 2.

After the worn work roll unit 11 is removed for refurbishing, actuator 32 is operated to drive stage 33 along ways 31 until the slide-rails 29*a* are aligned with the lift-rails 7 that are in their raised position within the mill stand. A new work roll unit 11*a* is pushed along the slide-rails 29*a* and onto the lift-rails 7 to a position where the upper and lower work roll chocks are properly captured within the upper and lower backup roll chocks as illustrated in FIG. 2. The actuators 6*a* and 6*b* are operated in a reversed vertical direction to lower the work roll unit 11*a,* bring the lower work roll 3 into contact with the lower backup roll 5, and disengaging the lift-rail extensions 27 from their corresponding lift surfaces 9 along the bottom chocks 3*a* and 3*b*. The upper backup roll 4 is lowered into contact with the upper work roll 2 using the appropriate mill stand raising/lowering mechanism 41 as shown in FIG. 1, and the roll gap is adjusted to place the mill in condition for rolling product.

Although the above description is directed to using the roll change device of the present invention in a four-high rolling mill stand, it should be understood that the roll change device as herein disclosed may be incorporated into the manufacture of any new four-high rolling mill stand without departing from the scope of this invention. As such, the invention has been disclosed in terms of preferred embodiments thereof which fulfills each and every one of the objects of the present invention as set forth above and provides a new and improved apparatus for replacing work rolls in a four-high mill stand. Of course, various changes, modifications and alterations from the teachings of the present invention may be contemplated by those skilled in the art without departing from the intended spirit and scope thereof. It is intended that the present invention only be limited by the terms of the appended claims.

I claim:

1. A roll change apparatus for changing a work roll assembly that includes a work roll mounted in work roll chocks moveably contained within pockets in backup roll chocks that support a backup roll within a four-high rolling mill stand, comprising:

a) actuators fastened to opposed inboard facing surfaces of the backup roll chocks that support the backup roll in the four-high rolling mill stand;

b) parallel spaced apart lift-rails attached to said actuators such that one end of each said lift-rail extends to a position below one of the work roll chocks and such that an opposite end of each said lift-rail extends to a position below the other work roll chock, each said extended lift-rail portion engaging a surface of the work roll chocks and lifting said work roll assembly to a roll changing position located above the backup roll when said actuators are operated to move said lift-rails in an upward direction, and each said extended lift-rail portion disengaging from said surface of the work roll chocks when the work roll contacts the lower backup roll in response to said actuators operated in a downward direction.

2. The invention recited in claim 1, comprising:

a) a lift-rail hook positioned at opposite end portions of each said lift-rail, each lift-rail hook attached to an extendable portion of one of said actuators so that said lift-rail is moved in an upward direction when said extendable portion is lengthened, and so that said lift-rail is moved in a downward direction when said extendable portion is retracted.

3. The invention recited in claim 2 wherein each said lift-rail hook comprises:

a) an inverted cavity portion adapted to fit over and enclose said actuators, said inverted cup shaped portion having;

i) an open end for receiving said actuator;

ii) a closed end for engaging said extendable portion of said actuator, and iii) an inside surface defining said inverted cavity, said inside surface slideably engaging surfaces of said actuator to guide movement of said lift-rail when said actuators are operated.

4. The invention recited in claim 1 wherein said actuators include a mounting plate fastened within a pocket in the opposing inboard facing surfaces of the lower backup roll chocks.

5. The invention recited in claim 1 wherein said roll change apparatus further comprises:

a) a self-contained roll staging platform positioned within a mill floor portion adjacent the four-high rolling mill stand, said self-contained roll staging platform removable as a single unit from the position within the mill floor, said self-contained roll staging platform insertable as a single unit into the position within the mill floor.

6. The invention recited in claim 5 wherein said self-contained roll staging platform comprises:

a) a support platform portion positioned within the mill floor, said support platform portion including;

i) a plurality of jacks that bear against support members within the mill floor; and ii) a jack plate attached to said plurality of jacks such that said jack is moved when said plurality of jacks are operated;

b) a roll carriage moveably supported on said jack plate, said roll carriage including;

i) a roll carriage actuator that provides means for moving said roll carriage along said jack plate; and ii) at least two spaced apart slide-rail sets fastened to said roll carriage, said slide-rail sets arranged to selectively align vertically with said first lift-rail and said second lift-rail in said roll change position when said roll carriage actuator is operated to move said roll carriage, said slide-rail sets capable of being aligned horizontally with first lift-rail and said second lift-rail in said roll change position when said plurality of jacks are operated to move said jack plate.

7. The invention recited in claim 6 wherein said plurality of jacks are attached to a synchronized power train, comprising:

a) a gear and a drive shaft arrangement connected to said plurality of jacks such that said jacks are simultaneously operated to maintain said jack plate in a horizontal plane when said jack plate is moved;

b) power source attached to said gear and drive shaft arrangement to provide means for simultaneously operating said plurality of jacks.

8. The invention recited in claim 6 wherein said jack plate includes a shift-rail bridge positioned within a space located between said at least two shift-rail sets and said lift-rails.

9. A method of retrofitting a four-high rolling mill stand with a roll change apparatus, the steps of the method comprising:

machining opposite inboard facing surfaces of a first backup roll chock and a second backup roll chock that support a backup roll within the mill stand;

attaching actuators to the machined opposite inboard facing machined surfaces;

attaching a first lift-rail to a first selected set of said actuators fastened to the machined opposite inboard facing surfaces so that said first lift-rail is parallel to a lower work roll supported by a first work roll chock and a second work roll chock within the mill stand, said first lift-rail including a first end positioned below and shaped to engage the first work roll chock, and said first lift-rail including a second end positioned below and shaped to engage the second work roll chock; and attaching actuators to the machined opposite inboard facing machined surfaces;

attaching a second lift-rail to a second selected set of said actuators fastened to the machined opposite inboard facing surfaces so that said second lift-rail is parallel to a lower work roll opposite said first lift-rail, said second lift-rail including a first end positioned below and shaped to engage the first work roll chock, and said second lift-rail including a second end positioned below and shaped to engage the second work roll chock.

10. The method recited in claim 9 including the further step comprising:

machining outside surfaces along the first backup roll chock and the second backup roll chock to provide a clearance for said first end and said second end of said first lift-rail to extend to a position below the first work roll chock;

machining outside surfaces along the first backup roll chock and the second backup roll chock to provide a clearance for said first end and said second end of said second lift-rail to extend to a position below the first work roll chock and the second lower work roll chock.

11. The method recited in claim 9 wherein the step machining opposite inboard facing surfaces of the first backup roll chock and the second backup roll chock includes:

machining pockets along the opposite inboard facing surfaces, said machined pockets shaped to receive a mounting plate attached to each said actuator fastened to the opposite inboard facing surfaces.

12. The method recited in claim 9 including the further step comprising:

providing spaced apart lift-rail hooks attached to said first lift-rail to correspond with said first set of actuators, each lift-rail hook including a cavity shaped to receive and capture one of said actuators within said cavity, said cavity providing means for attaching said first lift-rail to said first set of actuators; and providing spaced apart lift-rail hooks attached to said second lift-rail to correspond with said second set of actuators, each lift-rail hook including a cavity shaped to receive and capture one of said actuators within said cavity, said cavity providing means for attaching said second lift-rail to said second set of actuators.

13. The method recited in claim 12 including the further step comprising:

engaging a surface that defines said cavity of said lift-rail hooks against an outside surface of said actuators to provide a sliding contact that guides lift-rail movement when said actuators are operated.

14. The method recited in claim 8 including the further step comprising:

a mill floor opening and support means for receiving a self-contained roll-staging platform adjacent the four-high rolling mill stand;

delivering within the mill floor opening, and placing upon the support means, a self-contained roll-staging platform including;

a support platform housed within the mill floor opening, said support platform including a plurality of jacks bearing against the support means and attached to a jack plate; and a roll carriage moveably attached to said jack plate, said roll carriage including a roll carriage actuator and at least two spaced apart slide-rail sets, said roll carriage actuator providing means to move said roll carriage in a direction such that one of said at least two slide-rail sets is selectively aligned vertically with said first lift-rail and said second lift rail in a roll change position, said plurality of jacks providing means to move said jack plate in a direction such that said at least two slide-rail sets are align horizontally with said first lift-rail and said second lift rail in the roll change position.

15. The method recited in claim 14 including the further steps comprising:

positioning said plurality of screw jacks to bear against the support means in said mill floor opening;

selectively adjusting said plurality of said jackscrews such that said jack plate is leveled in a horizontal plane.

16. A roll change device comprising:

a) a pair of spaced apart work roll lift assemblies, each work roll lift assembly including;

i) a set of actuators fastened to opposite inboard facing surfaces of backup roll chocks that support a backup roll in a four-high rolling mill stand ii) a lift-rail attached to said set of actuators, said lift-rail positioned to engage and lift work roll chocks that support a work roll within the four-high rolling mill stand when said set of actuators is operated to raise said lift-rail to a roll change position, said lift-rail positioned to disengage from the work roll chocks when said actuators are operated to lower the lift-rail to a rolling position.

17. The invention recited in claim 16 wherein said roll change device comprises:

a) a self-contained roll staging platform assembly positioned adjacent the four-high rolling mill stand and including a roll carriage, said roll carriage including;

i) means to move said roll carriage to a first position to receive work rolls from the mill stand; and ii) means to move said roll carriage to a second position to deliver work rolls to the mill stand.

18. The invention recited in claim 16 wherein said self-contained roll staging platform is removable as a single unit from its working position adjacent the four-high rolling mill stand.

19. The roll change device recited in claim 16 wherein said roll change device is a retrofit in an existing four-high rolling mill stand.

* * * * *